US007644693B2

(12) United States Patent
Cecur

(10) Patent No.: US 7,644,693 B2
(45) Date of Patent: Jan. 12, 2010

(54) OPEN ENDED MINI LASH ADJUSTER

(75) Inventor: Majo Cecur, Rivarolo Canavese (IT)

(73) Assignee: Eaton Corporation, Cleveland, OH (US)

( * ) Notice: Subject to any disclaimer, the term of this patent is extended or adjusted under 35 U.S.C. 154(b) by 121 days.

(21) Appl. No.: 11/629,595

(22) PCT Filed: Jun. 24, 2005

(86) PCT No.: PCT/IB2005/002143

§ 371 (c)(1),
(2), (4) Date: Dec. 14, 2006

(87) PCT Pub. No.: WO2006/003514

PCT Pub. Date: Jan. 12, 2006

(65) Prior Publication Data

US 2008/0066704 A1 Mar. 20, 2008

(30) Foreign Application Priority Data

Jun. 29, 2004 (EP) ..... 04253904

(51) Int. Cl.
*F01L 1/14* (2006.01)

(52) U.S. Cl. ..... 123/90.52; 123/90.45; 123/90.55; 123/90.57

(58) Field of Classification Search ..... 123/90.45, 123/90.46, 90.55, 90.52, 90.57
See application file for complete search history.

(56) References Cited

U.S. PATENT DOCUMENTS

| | | | | |
|---|---|---|---|---|
| 2,939,442 | A * | 6/1960 | John et al. | 123/90.51 |
| 5,347,963 | A | 9/1994 | Chung | |
| 6,325,034 | B1 * | 12/2001 | Edelmayer | 123/90.43 |
| 2003/0131815 | A1 * | 7/2003 | Hackett | 123/90.46 |

FOREIGN PATENT DOCUMENTS

| | | |
|---|---|---|
| DE | 195 09 052 | 2/1996 |
| EP | 0 600 381 | 6/1994 |
| EP | 0 985 805 | 3/2000 |

* cited by examiner

*Primary Examiner*—Zelalem Eshete
(74) *Attorney, Agent, or Firm*—John A. Kastelic

(57) ABSTRACT

A hydraulic lash adjuster (17;61;81) in which the body (19) defines a body bore (39) extending over substantially the entire axial length of the body, thus making it possible to finish the bore (39) by a more accurate process, such as honing. In the FIG. 2 embodiment, there is a cylindrical member (71) disposed in the lower portion of the body bore (39) cooperating to define a leakdown clearance (39,71 S), to isolate side load on the plunger (25) the leakdown. In the FIG. 3 embodiment, there is both the leakdown clearance (23S,39) between the body bore and the plunger (23) and the leakdown clearance (39,71 S) between the body bore and the cylindrical member (71), the leakdown flow rate of FIG. 3 being variable if the body and the cylindrical member (71) comprise dissimilar metals, having different coefficients of thermal expansion.

16 Claims, 3 Drawing Sheets

OPEN ENDED MINI LASH ADJUSTER

BACKGROUND OF THE DISCLOSURE

The present invention relates generally to hydraulic lash adjusters, and more particularly, to a hydraulic lash adjuster (HLA) of the type in which there is both a high pressure chamber and a low pressure (reservoir) chamber.

Hydraulic lash adjusters (also sometimes referred to as "lifters" or "lash compensation devices") for internal combustion engines have been in use for many years, and serve to eliminate the clearance (or lash) between engine valve train components under varying operating conditions, in order to maintain efficiency and to reduce noise and wear in the valve train. An HLA operates on the principal of transmitting the energy of the valve actuating cam through hydraulic fluid, trapped in a high pressure chamber under a plunger. During each operating cycle of the cam, as the length of the valve actuating components varies, as a result of temperature changes and wear, small quantities of hydraulic fluid are permitted to enter the pressure chamber, or escape therefrom, thus effecting an adjustment of the position of the plunger, and consequently adjusting the effective total length of the valve train.

The typical, prior art HLA comprises a generally cylindrical, cup-shaped body member which is disposed within a cylindrical bore defined by the engine cylinder head. Disposed within the body is a plunger assembly which is slidingly received within a blind bore defined by the body member. The lower end of the plunger assembly cooperates with the blind bore to define the high pressure chamber. In the conventional HLA, when a load is applied to the plunger assembly (from the cam profile, by means of a rocker arm), the load increases the pressure of the hydraulic fluid within the high pressure chamber, and fluid escapes the high pressure chamber through a cylindrical clearance defined between the blind bore and the outer cylindrical surface of the plunger. An HLA of the type described is referred to as a "conventional leakdown" lash adjuster. Although the present invention could be utilized in conjunction with various other types of HLA, it is especially adapted for use in an HLA of the conventional leak-down type, and will be described in connection therewith.

In a conventional leakdown HLA, in which the leakdown clearance is defined between the body bore and the plunger outer surface, it is understood by those skilled in the art that the diameter of the blind bore defined by the body must be maintained within a very tight tolerance range. Typically, the final step in machining/sizing the body bore is a grinding operation which, as is well known to those skilled in the art, tends to be a fairly expensive operation, in part because of the cup-shape of the body. Even after such an expensive grinding operation on the body bore, it is typical in the HLA art that the bodies and plungers are "sized and sorted" with regard to the body bore inner diameter and the plunger outer diameter, in order that, after assembly, each body-and-plunger pair has a leakdown clearance within the desire tolerance range. Even after the size and sort operation, and the match fitting of the plunger and body, it is fairly common to have leakdown performance outside of the tolerance range. When such unacceptable performance is identified, subsequent to assembly, it is then necessary to dis-assemble the HLA, and re-assemble the body and plunger from that HLA with other components, in an attempt to achieve HLA performance within the tolerance range. All of that type of "re-work" is time consuming and expensive, and should be avoided to the extent possible.

Those skilled in the art of hydraulic lash adjusters understand that, even though the rocker arm imposes a generally axial load on the plunger of an HLA, there is typically also a side load component applied to the plunger. As is also now well known, any such side load imposed on the plunger will effectively change the leakdown clearance between the body and the plunger, thus resulting in undesirable variations in the leakdown performance of the HLA.

BRIEF SUMMARY OF THE INVENTION

Accordingly, it is an object of the present invention to provide an improved hydraulic lash adjuster which makes it possible to substantially reduce the cost of machining and sizing the body bore, and substantially eliminates, or at least reduces, the need for the above-described size-and-sort operation.

It is a more specific object of the present invention to provide an improved hydraulic lash adjuster which accomplishes the above-stated objects, and which makes it possible, if desirable, to separate the leakdown function of the HLA from the side load imposed on the plunger assembly.

It is another object of the present invention to provide an improved hydraulic lash adjuster which accomplishes the above-stated objects, and also makes it feasible to provide a leakdown rate which varies, such as with changes in the temperature of the engine oil.

The above and other objects of the invention are accomplished by the provision of an improved hydraulic lash adjuster adapted to be disposed within a bore defined in an internal combustion engine, the lash adjuster comprising a body disposed within the bore defined in the engine, the body defining a generally cylindrical body bore, and a fluid port in communication with a source of fluid pressure. A plunger assembly includes a plunger member slidingly received within the body bore, and cooperating therewith to define a pressure chamber, the plunger assembly including a reservoir chamber in fluid communication with the fluid port. A biasing means normally urges the plunger assembly outward of the body bore, the plunger assembly including a portion adapted for engagement with an adjacent surface of a valve train component. A generally cylindrical member is disposed within a lower end of the body bore, the biasing means having a lower end thereof seated relative to the cylindrical member. The plunger assembly includes check valve means operable to control fluid communication between the reservoir chamber and the pressure chamber in response to the pressure difference therebetween.

The improved hydraulic lash adjuster is characterized by the body bore extending over the entire axial length of the body. The body bore and one of the plunger member and the cylindrical member cooperate to define a leakdown clearance, permitting fluid communication from the pressure chamber to the reservoir chamber, in response to movement of the plunger assembly inward of the body bore.

In accordance with a more limited aspect of the present invention, the body bore and the generally cylindrical member cooperate to define the leakdown clearance, the plunger member defining a radial fluid passage permitting fluid flow from between the bore defined in the engine and the body, through the fluid port, then through the radial fluid passage into the reservoir chamber.

DETAILED DESCRIPTION OF THE PREFERRED EMBODIMENT

Figure 1:
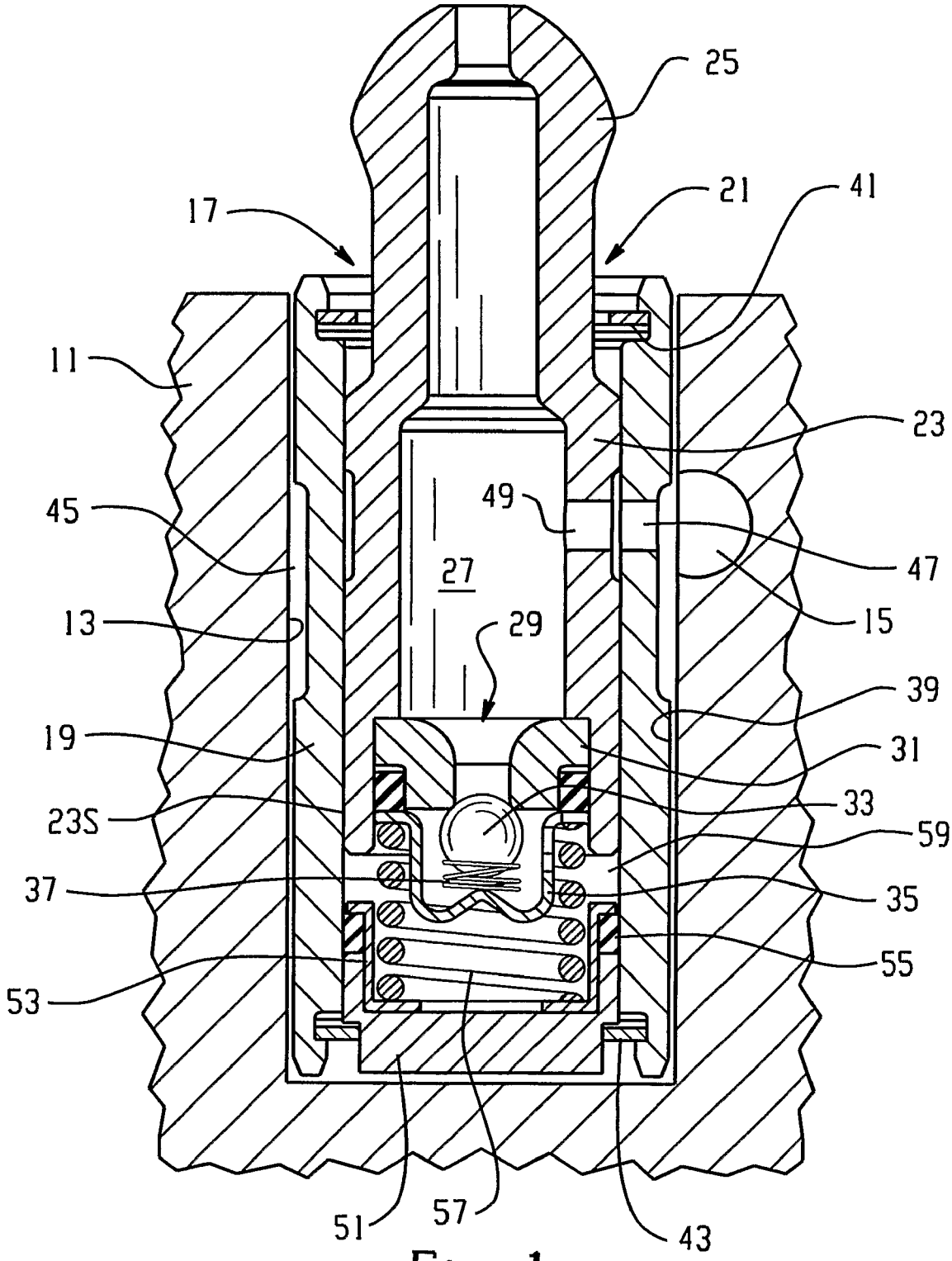
FIG. 1 is a fragmentary, axial cross-section through one embodiment of the present invention.

Referring now to the drawings, which are not intended to limit the present invention, FIG. 1 is a fragmentary, axial cross-section through a cylinder head 11 which defines a generally cylindrical bore 13. The bore 13 is referred to hereinafter in the appended claims as the "bore defined within the engine", it being understood that the bore 13 would typically, but not necessarily, be defined by the cylinder head 11. The cylinder head 11 defines a fluid passage 15 which intersects the bore 13 and comprises, for purposes of the subsequent description of the invention and the appended claims, a "source of fluid pressure". As is known in the art, the fluid passage 15 would typically be in fluid communication with the engine lubrication circuit.

Disposed within the bore 13 defined within the engine is a hydraulic lash adjuster, generally designated 17, which comprises a body 19 and a plunger assembly, generally designated 21. It should be noted that, for ease of illustration, there appears to be a radial gap between the cylindrical bore 13 and an outer cylindrical surface of the body 19, whereas, in reality, there would be a fairly close, sliding fit between the bore 13 and the body 19, as is already well known to those skilled in the HLA art.

The plunger assembly 21 includes a generally cylindrical plunger member 23, which is slidingly received within the body 19, as was mentioned previously. The plunger member 23 includes, at its upper end in FIG. 1, a ball plunger portion 25 which would typically be in engagement with a mating surface of a valve train component, such as a rocker arm (not shown herein) in a manner well known to those skilled in the art, and which forms no part of the present invention. Disposed within the plunger member 23 is a low pressure reservoir chamber 27.

Disposed within a lower end of the plunger member 23, and comprising part of the plunger assembly 21, is a check valve assembly, generally designated 29, which includes a seat member 31, against which is seated a check ball 33. Beneath the check ball 33 is a retainer member 35, against which is seated a compression spring 37, biasing the check ball 33 toward engagement with the seat member 31. Although it is conventional for an HLA to include a check valve assembly, it should be understood that the present invention is not limited to any particular type or configuration of check valve assembly. For example, although the check valve assembly 29 shown in FIG. 1 is of the "normally biased closed" type, it would also be within the scope of the invention to utilize a check valve assembly of the "normally biased open" type or of the "free ball" type in which there is no spring biasing the check ball, toward either a closed position or toward an open position.

Referring still primarily to FIG. 1, and in accordance with one important aspect of the invention, the body 19 defines a body bore 39 which is substantially cylindrical, and extends over substantially the entire axial length of the body 19, i.e., the diameter of the body bore 39 is the same over the entire axial length of the body bore 39. It should be noted in FIG. 1 that the body bore 39 is slightly shorter, axially, than the body 19 because, at the upper axial end of the body 19 is a retainer 41, seated within an annular groove defined by the body 19. Similarly, at the lower axial end of the body 19 there is a C-clip 43 disposed within an annular groove defined by the body 19, for reasons which will be explained subsequently. However, for purposes of the present invention and the appended claims, the body bore 39 shown in FIG. 1 extends "over substantially the entire axial length" of the body 19.

It is one important advantage of the present invention that, because the body 19 is not cup-shaped as in the prior art, but instead, is tubular and open from both ends, it is possible to finish machining and sizing the body bore 39 by means of a honing operation. As was mentioned in the BACKGROUND OF THE DISCLOSURE, in the case of the typical, prior art, cup-shaped HLA body, it was necessary to perform a relatively more expensive grinding operation in order to finish machine the body bore. The ability to utilize a finishing process such as honing, in accordance with the present invention, provides a substantial improvement in the overall manufacturing process for making high quality, cost-effective (closer tolerance) hydraulic lash adjusters.

In a manner which is now well known to those skilled in the HLA art, but is not essential to the invention, the body 19 defines, about its outer periphery, a cylindrical recess 45 which is positioned to be in continuous, open fluid communication with the fluid passage 15. The body 19 also defines a radial fluid port 47, in communication with the recess 45, and similarly, the plunger member 23 defines a radial fluid port 49, such that the reservoir chamber 27 is in continuous fluid communication with the source of the fluid pressure, i.e., the fluid passage 15.

Disposed within a lower axial end of the body bore 39 of the body 19 is a generally cylindrical member 51 which, in the subject embodiment, is somewhat cup-shaped and has disposed therein a stamped retainer member 53, which serves several purposes. One purpose for the retainer 53 is to maintain a seal member 55 in engagement with the axially upper portion of the cylindrical member 51, and in sealing engagement with the body bore 39. In addition, the retainer 53 serves as a seat, against which is disposed the lower axial end of a compression spring 57 (also referred to as a "plunger spring"), the upper end of which is seated against the retainer member 35. As is well known to those skilled in the art, the primary function of the compression spring 57 is to normally bias the plunger assembly 21 "outward" of the body bore 39, i.e., in an upward direction in FIG. 1. The region within the body bore 39, disposed axially between the plunger assembly 21 and the cylindrical member 51 (i.e., the region surrounding the spring 57) comprises a pressure chamber 59, such that the check ball 33 controls fluid flow between the low pressure reservoir chamber 27 and the pressure chamber 59, in response to the pressure differential therebetween, in a manner which is typical and is now well known to those skilled in the HLA art.

As was mentioned previously, the seal member 55 engages, and seals against, the body bore 39, thus preventing any substantial flow or leakage of fluid from the pressure chamber 59, past the cylindrical member 51 into the cylindrical bore 13 surrounding the HLA 17. Instead, in the embodiment of FIG. 1, the body bore 39 and an outer cylindrical surface 23S, of the plunger member 23, cooperate to define a conventional leakdown path which will be referred to by the reference numerals of the surfaces which define the leakdown path, such that the leakdown path is hereinafter referenced as "23S,39". Therefore, the embodiment of FIG. 1 is fairly conventional in its operation, but, as was explained previously, would be substantially more cost-effective to manufacture, because of the ability to finish machine and size the body bore 39 by means of an operation such as honing. Thus, after the size and sort operation involving the body 19 and the plunger member 23, there should be substantially less re-work, utilizing the present invention, than was previously required.

Figure 2:
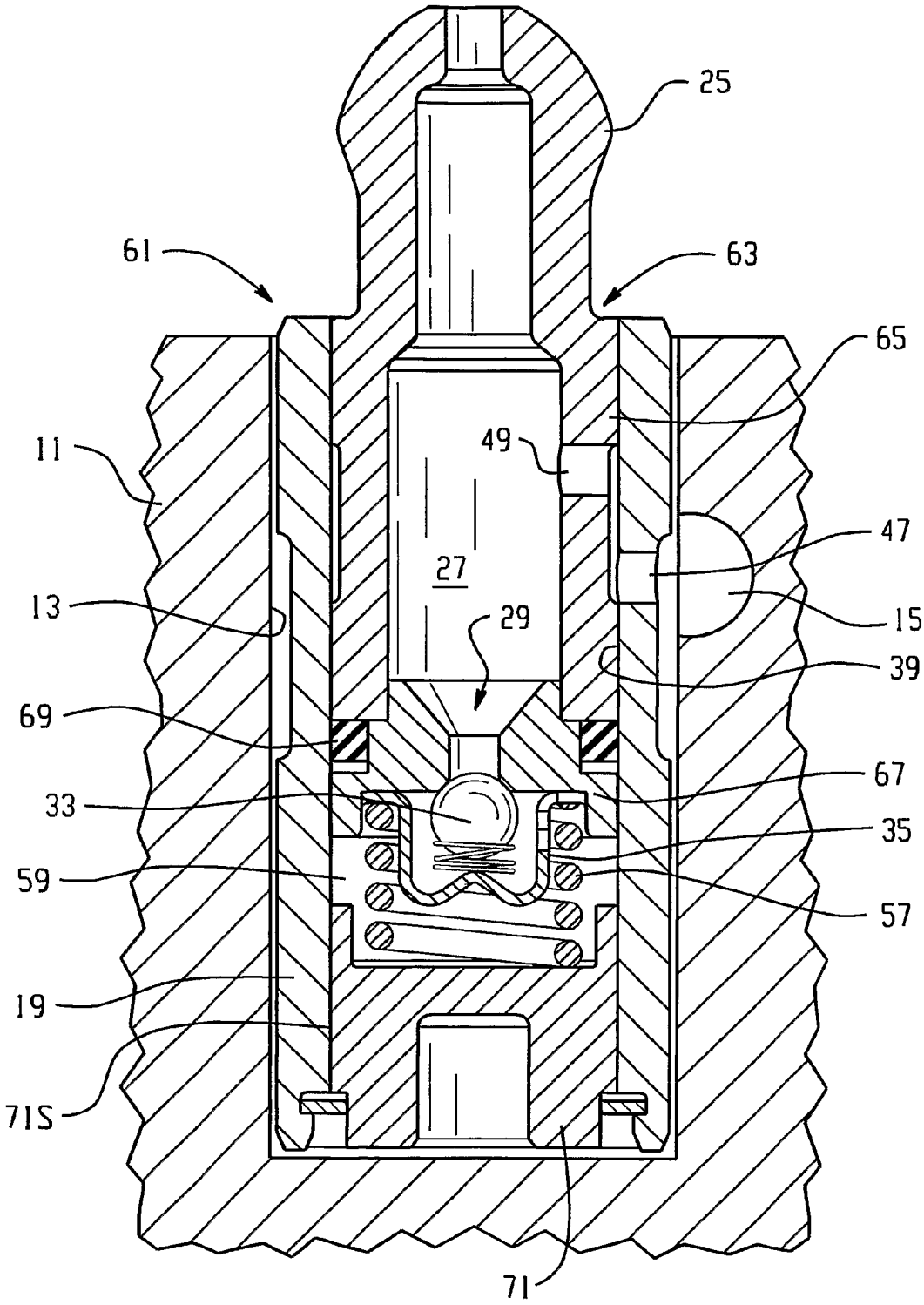
FIG. 2 is a fragmentary, axial cross-section, on a slightly larger scale than FIG. 1, showing an alternative embodiment of the present invention.

Referring now primarily to FIG. 2, there is illustrated an alternative embodiment of the present invention, in which like elements bear like numerals, and new, or substantially modified elements bear reference numerals in excess of "60". Therefore, FIG. 2 illustrates a modified HLA, generally designated 61, having a plunger assembly 63, including a plunger member 65 which defines the ball plunger portion 25. Disposed at the lower end of the plunger member 65 is the check valve assembly 29 which, in the embodiment of FIG. 2, merely has a different configuration of a seat member 67. One reason for the difference in the configuration of the seat member 67 is that, trapped between the lower end of the plunger member 65 and a shoulder defined by the seat member 67 is a seal member 69, the function of which is to prevent any substantial flow of fluid from the pressure chamber 59 upward in FIG. 2 between the body bore 39 and the outer cylindrical surface of the plunger member 65, for reasons which will be explained subsequently.

Referring still primarily to FIG. 2, it may be seen that the body 19 may be substantially identical to the body 19 of the FIG. 1 embodiment although, as shown in FIG. 2, the body 19 does not include the annular groove in which is disposed the retainer 41 of the FIG. 1 embodiment. However, as will be understood by those skilled in the art, the presence or absence of the retainer 41 in either of the embodiments is not in any way essential to the practice of the present invention.

Disposed within the lower end of the body bore 39 is a generally cylindrical member 71 which includes, toward its upper end, a generally cup-shaped portion in which is disposed the lower end of the compression spring 57, in the same general manner as in the FIG. 1 embodiment. As was described in connection with the FIG. 1 embodiment, the body bore 39 in the FIG. 2 embodiment may be machined and finished in a more cost-effective manner, such as by honing, for reasons which were described previously. One difference in the FIG. 2 embodiment is that, because the plunger member 65 does not cooperate with the body bore 39 to define a leakdown clearance (but instead, such flow is prevented by the seal member 69), there can be a much looser tolerance associated with the outer surface of the plunger member 65. Furthermore, any side load applied to the plunger member 65 as a result of the engagement of components such as a rocker arm with the ball plunger portion 25, will not affect the leakdown clearance, and therefore, will not affect the leakdown rate. In accordance with one important aspect of the FIG. 2 embodiment, the part of the HLA 61 which is subjected to side loading is separated from that portion which defines the leakdown clearance.

Therefore, in accordance with another important aspect of the FIG. 2 embodiment, the generally cylindrical member 71 defines a cylindrical outer surface 71S, and the body bore 39 and the outer cylindrical surface 71S cooperate to define a leakdown path, which will hereinafter be referred to as "39, 71S". During operation of the engine, when the rocker arm or other engine component applies an axial loading to the ball plunger portion 25, causing an increase in fluid pressure in the pressure chamber 59, there will be a controlled flow of leakage fluid from the pressure chamber 59 through the leakdown path 39,71S into the lower portion of the cylindrical bore 13. Fluid exiting the leakdown path will then flow between bore 13 and the body 19, in an upward direction in FIG. 2, then will flow radially inward through the fluid ports 47 and 49 into the low pressure reservoir chamber 27.

Figure 3:
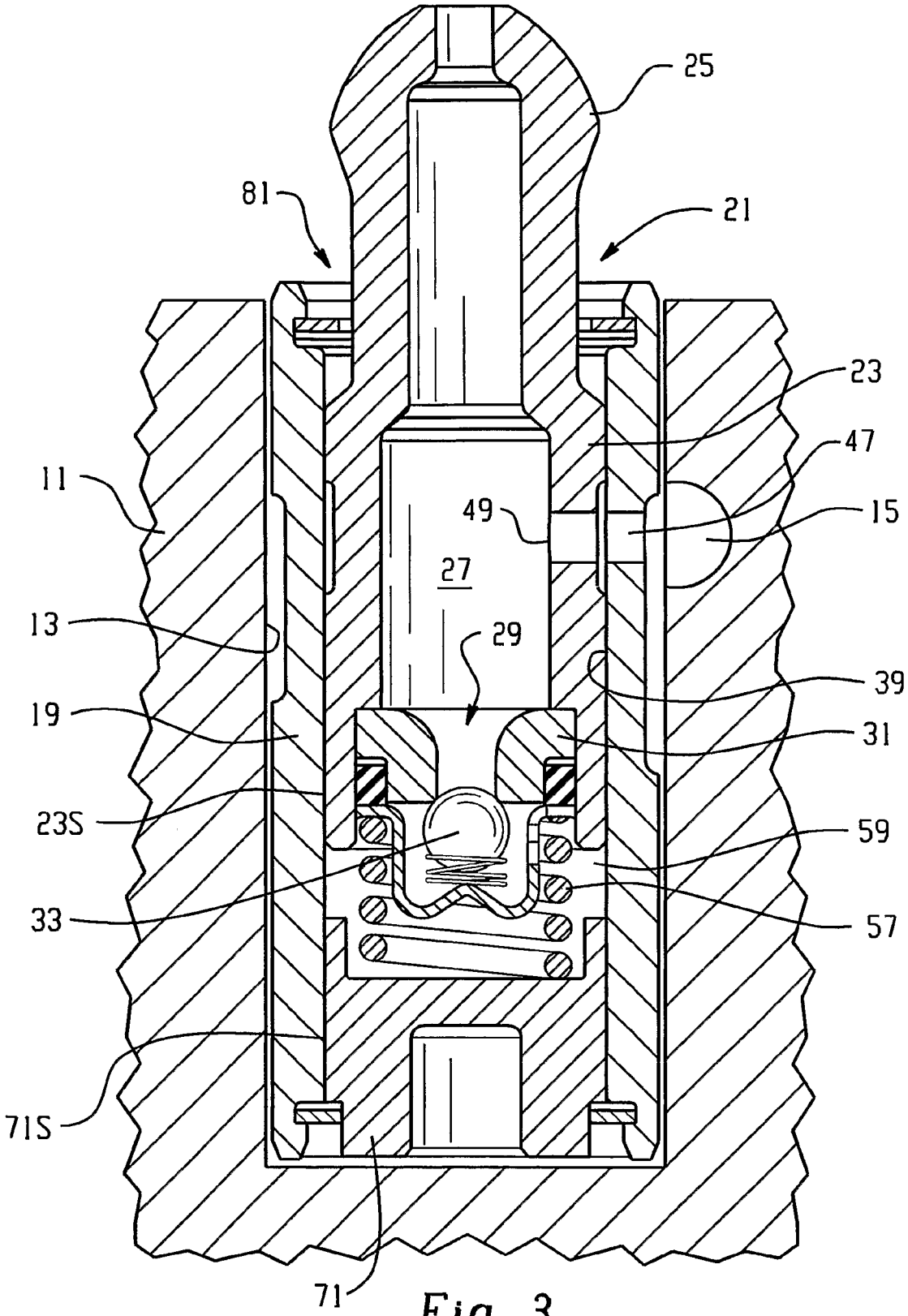
FIG. 3 is a fragmentary, axial cross-section, on approximately the same scale as FIG. 2, showing another alternative embodiment of the present invention.

Referring now primarily to FIG. 3, there is illustrated another alternative embodiment of the present invention, in which like elements bear like numerals, and new, or substantially modified elements bear reference numerals in excess of "80". FIG. 3 illustrates a modified HLA, generally designated 81, in which the body 19 may be substantially the same as in either of the earlier embodiments, and the plunger assembly 21 of the first embodiment is included, including the check valve assembly 29 shown in FIG. 1. Therefore, in the FIG. 3 version, there is a conventional leakdown clearance 23S,39, as described previously in connection with the FIG. 1 embodiment.

In the FIG. 3 alternative embodiment, instead of the generally cylindrical member 51 of the FIG. 1 version, the generally cylindrical member 71 of the FIG. 2 embodiment is included. As a result, there is also a leakdown clearance 39,71S defined between the lower portion of the body 19 and the cylindrical member 71, as in the FIG. 2 embodiment.

However, in accordance with a further aspect of the present invention, in the FIG. 3 embodiment, the cylindrical member 71 comprises a different material than does the body 19. By means of example only, the body 19 typically comprises a low carbon steel, and in the subject embodiment, the cylindrical member 71 of FIG. 3 comprises a material such as bronze, having a substantially different coefficient of thermal expansion than the steel body 19. Those skilled in the art will understand that none of the embodiments of the invention are limited to any particular material, except as specifically otherwise recited in the appended claims.

Specifically, in the FIG. 3 embodiment, the materials utilized for the body 19 and the cylindrical member 71 are selected such that the cylindrical member 71 has at least a somewhat greater coefficient of thermal expansion. As a result, and by way of example only, the dimension of the body bore 39 and the cylindrical member 71 are selected such that, when the engine oil is cold (room temperature), the leakdown clearance 39,71S is about two-thirds of the total leakdown clearance, with the leakdown clearance 23S,39 comprising the other one-third. Then, as the engine begins to operate, and the engine oil gets warmer, the cylindrical member 71 of the FIG. 3 version begins to grow at a faster rate than does the body 19. Thus, the leakdown clearance 39,71S begins to decrease, and that process continues until the engine oil achieves its maximum (normal) operating temperature. The material and dimensions for the cylindrical member 71 may be selected such that, at maximum oil temperature, the leakdown clearance 39,71S decreases, approaching (and possibly even reaching) a zero clearance condition. When that occurs, only the leakdown clearance 23S,39 remains open and in effect, such that (in accordance with the example above), the total leakdown flow at maximum oil temperature is only about one-third of the leakdown flow at cold (start-up) temperature. It is believed that the FIG. 3 version may therefore be of benefit in dealing with situations such as CSSR ("cold start spark retard").

Thus, it may be seen that the present invention provides a series of benefits, and a hydraulic lash adjuster may, in accordance with the present invention, be designed to take advantage of only some of the benefits, such as more accurate finishing of the body bore 39 and less re-work (FIG. 1 embodiment), or the HLA may be designed also to take advantage of the ability to separate the side load on the ball plunger from the leakdown clearance (FIG. 2 embodiment). Finally, the HLA may be designed to take advantage of the benefit of less re-work while also having the capability of total leakdown flow being variable, in response to variations in the temperature of the engine oil (FIG. 3 embodiment).

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

The invention claimed is:

1. A hydraulic lash adjuster adapted to be disposed within a blind bore having a bottom and defined in an internal combustion engine, the lash adjuster comprising:

a body configured to be disposed within said bore defined in said engine, the body defining a generally cylindrical body bore that extends over the entire axial length of the body, and a fluid port in communication with a source of fluid pressure;

a plunger assembly including a plunger member slidingly received within the body bore, and cooperating therewith to define a pressure chamber, the plunger assembly including a reservoir chamber in fluid communication with the fluid port;

biasing means normally configured to urge the plunger assembly outward of the body bore, the plunger assembly including a portion adapted for engagement with an adjacent surface of a valve train component; and a generally cylindrical member disposed within a lower end of the body bore such that substantially the entire cylindrical member is provided within the body bore and the cylindrical member is adjacent a portion of said bore;

wherein the biasing means includes a lower end thereof connected or seated, relative to the cylindrical member, the lower end of the biasing means being in a substantially fixed positional relationship with said bottom of said bore; the plunger assembly includes a check valve operable to control fluid communication between the reservoir chamber and the pressure chamber in response to the pressure difference therebetween; and the body bore and one of the plunger member and the cylindrical member cooperate to define a leakdown clearance permitting fluid communication from the pressure chamber to the reservoir chamber in response to movement of the plunger assembly inward of the body bore.

2. The lash adjuster according to claim 1, wherein the biasing means comprises a spring.

3. The lash adjuster according to claim 2, wherein the biasing means comprises a compression spring.

4. The lash adjuster according to claim 1, wherein the a plunger member has a longitudinal length that extends along a majority of the length of the body bore.

5. The lash adjuster according to claim 1, wherein the body bore and the plunger member cooperate to define the leakdown clearance, and the plunger member defines a radial fluid passage providing fluid communication from the leakdown clearance to the reservoir chamber.

6. The lash adjuster according to claim 5, wherein the generally cylindrical member is loosely received within the body bore and has associated therewith a seal member in engagement with the body bore to prevent any substantial fluid flow past the cylindrical member.

7. The lash adjuster according to claim 1, wherein the body bore and the generally cylindrical member cooperate to define the leakdown clearance, the plunger member defines a radial fluid passage permitting fluid flow from between the bore defined in said engine and the body, through the fluid port, then through the radial fluid passage into the reservoir chamber.

8. The lash adjuster according to claim 7, wherein the plunger member being loosely received within said body bore and having associated therewith a seal member in engagement with said body bore to prevent any substantial fluid flow between said body bore and said plunger member.

9. The lash adjuster according to claim 1, wherein the body and the cylindrical member comprise dissimilar metals, having different coefficients of thermal expansion.

10. The lash adjuster according to claim 9, wherein, upon an increase in temperature, the coefficients of thermal expansion are such that the cylindrical member grows at a faster rate than the body.

11. The lash adjuster according to claim 9, wherein the body is comprised of steel and the cylindrical member is comprised of bronze.

12. The lash adjuster according to claim 9, wherein the dissimilar metals for the body and for the cylindrical member are selected such that, when the engine is cold, the leakdown clearance is relatively large, and when the engine is hot, the leakdown clearance is relatively small.

13. The lash adjuster according to claim 1, wherein the wherein the body and the cylindrical member comprise dissimilar metals having different coefficients of thermal expansion, and the dimensions of the body bore and cylinder member are configured such that, at room temperature, the leakdown clearance between the body bore and the cylindrical member is about one-third of the total leakdown clearance.

14. The lash adjuster according to claim 1, wherein the leakdown clearance is variable with temperature, and as a maximum operating temperature is neared, the leakdown clearance reduces and approaches a zero clearance condition.

15. A hydraulic lash adjuster adapted to be disposed within a blind bore defined in an internal combustion engine, the lash adjuster comprising a body disposed within said bore defined in said engine, the body defining a generally cylindrical body bore, and a fluid port in communication with a source of fluid pressure; a plunger assembly including a plunger member slidingly received within the body bore, and cooperating therewith to define a pressure chamber, the plunger assembly including a reservoir chamber in fluid communication with the fluid port; biasing means normally urging the plunger assembly outward of the body bore, the plunger assembly including a portion adapted for engagement with an adjacent surface of a valve train component; and a generally cylindrical member disposed within a lower end of the body bore, the biasing means having a lower end thereof seated, relative to the cylindrical member; the plunger assembly including check valve means operable to control fluid communication between the reservoir chamber and the pressure chamber in response to the pressure difference therebetween; wherein:

the body bore extends over the entire axial length of the body;

the body bore and one of said plunger member and the cylindrical member cooperating to define a leakdown clearance permitting fluid communication from the pressure chamber to the reservoir chamber in response to movement of the plunger assembly inward of the body bore;

the body bore and the plunger member cooperate to define the leakdown clearance, the plunger member defining a radial fluid passage providing fluid communication from the leakdown clearance to the reservoir chamber; and the generally cylindrical member being loosely received within the body bore and having associated therewith a seal member in engagement with the body bore to prevent any substantial fluid flow past the cylindrical member.

16. A hydraulic lash adjuster adapted to be disposed within a blind bore defined in an internal combustion engine, the lash adjuster comprising a body disposed within said bore defined in said engine, the body defining a generally cylindrical body bore, and a fluid port in communication with a source of fluid pressure; a plunger assembly including a plunger member slidingly received within the body bore, and cooperating therewith to define a pressure chamber, the plunger assembly including a reservoir chamber in fluid communication with the fluid port; biasing means normally urging the plunger assembly outward of the body bore, the plunger assembly including a portion adapted for engagement with an adjacent surface of a valve train component; and a generally cylindrical member disposed within a lower end of the body bore, the biasing means having a lower end thereof seated, relative to the cylindrical member; the plunger assembly including check valve means operable to control fluid communication between the reservoir chamber and the pressure chamber in response to the pressure difference therebetween; wherein:

the body bore extending over the entire axial length of the body;

the body bore and one of the plunger member and the cylindrical member cooperating to define a leakdown clearance permitting fluid communication from the pressure chamber to the reservoir chamber in response to movement of the plunger assembly inward of the body bore;

the body bore and the generally cylindrical member cooperating to define the leakdown clearance, the plunger member defining a radial fluid passage permitting fluid flow from between said bore defined in said engine and the body, through the fluid port, then through the radial fluid passage into the reservoir chamber; and the plunger member being loosely received within the body bore and having associated therewith a seal member in engagement with the body bore to prevent any substantial fluid flow between the body bore and the plunger member.

* * * * *